US009443681B2

(12) United States Patent
Siebens

(10) Patent No.: US 9,443,681 B2
(45) Date of Patent: Sep. 13, 2016

(54) FLEXIBLE DIELECTRIC MATERIAL FOR HIGH VOLTAGE SWITCH

(71) Applicant: Thomas & Betts International, Inc., Wilmington, DE (US)

(72) Inventor: Larry N. Siebens, Asbury, NJ (US)

(73) Assignee: Thomas & Betts International LLC DE (US)

( * ) Notice: Subject to any disclaimer, the term of this patent is extended or adjusted under 35 U.S.C. 154(b) by 221 days.

(21) Appl. No.: 14/268,159

(22) Filed: May 2, 2014

(65) Prior Publication Data

US 2015/0027986 A1 Jan. 29, 2015

Related U.S. Application Data

(60) Provisional application No. 61/859,342, filed on Jul. 29, 2013.

(51) Int. Cl.

| | |
|---|---|
| ***H01H 33/42*** | (2006.01) |
| ***H01H 33/22*** | (2006.01) |
| ***H01H 11/00*** | (2006.01) |
| ***H01H 33/66*** | (2006.01) |

(52) U.S. Cl.

CPC ..... *H01H 33/22* (2013.01); *H01H 11/00* (2013.01); *H01H 33/42* (2013.01); *H01H 33/6606* (2013.01); *Y10T 29/49105* (2015.01)

(58) Field of Classification Search

CPC ... H01H 33/42; H01H 33/6606; H01H 11/00
USPC ..... 218/7, 14, 92, 93, 140, 153, 154, 155
See application file for complete search history.

(56) References Cited

U.S. PATENT DOCUMENTS

| | | | |
|---|---|---|---|
| 3,233,069 | A | 2/1966 | Date |
| 4,079,217 | A | 3/1978 | Oeschger |
| 4,513,208 | A | 4/1985 | Kamata |
| 4,804,809 | A | 2/1989 | Thompson, Jr. et al. |
| 4,956,742 | A | 9/1990 | Takagi et al. |
| 5,025,171 | A | 6/1991 | Fanta et al. |
| 5,254,814 | A | 10/1993 | Harr |

(Continued)

FOREIGN PATENT DOCUMENTS

| | | | |
|---|---|---|---|
| CA | 2003844 | A1 | 10/1993 |
| CA | 2022949 | A1 | 10/1993 |

(Continued)

*Primary Examiner* — Amy Cohen Johnson
*Assistant Examiner* — Marina Fishman
(74) *Attorney, Agent, or Firm* — Taft Stettinius & Hollister LLP

(57) ABSTRACT

An electrical switch includes a tubular housing having a conductor receiving end and an operating end opposite the conductor receiving end. The tubular housing also includes a conductive interface positioned intermediate the conductor receiving end and the operating end. An operating rod extends through the operating end toward the conductor receiving end. The operating rod is moveable between a first position to engage the electrical switch and a second position to disengage the electrical switch. A gelatinous dielectric material is provided within a portion of the tubular housing, and around the operating rod, in the operating end to prevent voltage from the conductive interface from arcing to the operating end. The gelatinous dielectric material is configured to deform to maintain contact with the operating rod in the first position and the second position.

20 Claims, 4 Drawing Sheets

(56) References Cited

U.S. PATENT DOCUMENTS

| | | | | |
|---|---|---|---|---|
| 5,311,161 | A | 5/1994 | Calder et al. | |
| 5,457,292 | A | 10/1995 | Harr | |
| 5,667,060 | A | 9/1997 | Luzzi | |
| 5,834,909 | A | 11/1998 | Marmonier | |
| 5,864,942 | A | 2/1999 | Luzzi | |
| 6,396,018 | B1 | 5/2002 | Kinoshita et al. | |
| 6,797,909 | B2 | 9/2004 | Pride et al. | |
| 6,818,850 | B2 | 11/2004 | Bridges | |
| 6,927,355 | B2 | 8/2005 | Thuresson et al. | |
| 7,009,130 | B2 | 3/2006 | Hashimoto et al. | |
| 7,432,787 | B2 | 10/2008 | Muench et al. | |
| 7,479,612 | B2 | 1/2009 | Waldi et al. | |
| 7,630,189 | B2 | 12/2009 | Lalonge | |
| 8,115,134 | B2 | 2/2012 | Yanase et al. | |
| 8,139,345 | B2 | 3/2012 | Christensen et al. | |
| 8,674,254 | B2 * | 3/2014 | Borgstrom | H01H 33/42 218/155 |
| 2002/0088775 | A1 | 7/2002 | Bridges | |
| 2005/0189325 | A1 | 9/2005 | Schweizer et al. | |
| 2006/0011589 | A1 | 1/2006 | Hering et al. | |
| 2010/0046146 | A1 | 2/2010 | Christensen et al. | |
| 2012/0193325 | A1 * | 8/2012 | Borgstrom | H01H 33/42 218/154 |

FOREIGN PATENT DOCUMENTS

| | | | |
|---|---|---|---|
| CA | 2715849 | A1 | 9/2009 |
| CA | 2747226 | A1 | 6/2010 |
| CA | 2747227 | A1 | 7/2010 |
| CA | 2766332 | A1 | 12/2010 |
| CA | 2784941 | A1 | 7/2011 |
| CA | 2731085 | A1 | 8/2011 |
| CA | 2744437 | A1 | 1/2012 |
| CA | 2747506 | A1 | 1/2012 |
| CN | 1156891 | A | 8/1997 |
| EP | 2482301 | A1 | 8/2012 |
| JP | H05314871 | A | 11/1993 |
| JP | 2012160450 | A | 8/2012 |

* cited by examiner

FLEXIBLE DIELECTRIC MATERIAL FOR HIGH VOLTAGE SWITCH

CROSS-REFERENCE TO RELATED APPLICATION

This application claims priority under 35 U.S.C. §119, based on U.S. Provisional Patent Application No. 61/859,342 filed Jul. 29, 2013, the disclosure of which is hereby incorporated by reference herein.

BACKGROUND OF THE INVENTION

The present invention relates to high voltage electrical switches, such as high voltage circuit breakers, switchgear, and other electrical equipment. More particularly, the invention relates to an electrical switch whose contacts are located within an insulating environmental enclosure, such as a ceramic bottle. One of the contacts may be actuated by a mechanical system outside of the enclosure connected by a shaft extending through an enclosure seal.

In conventional systems, the actuating mechanisms typically form a ground connection in the switch and, unless precautions are taken, current may arc from the switch assembly to the actuating mechanism, causing failure or damage. To address this, conventional high voltage switches, such as overhead reclosers, typically utilize a lengthy fiberglass pull rod to connect the actuating mechanism to the switch contact. The insulative fiberglass rod extends through an air filled cavity. Air requires a long distance between contacts in order to reduce the likelihood of arcing in high voltage (e.g., 3+kV) environments. Thus, this configuration takes a significant amount of physical space.

DETAILED DESCRIPTION OF THE PREFERRED EMBODIMENTS

The following detailed description refers to the accompanying drawings. The same reference numbers in different drawings may identify the same or similar elements.

According to implementations described herein, a chamber partially-filled with a flexible silicone gel is used as a dielectric material to isolate an operating rod (also referred to as a "pull rod" or "driver rod") in a high voltage electrical switch. The silicone gel acts as a flexible insulating compound that adheres to the operating rod and the chamber wall. The silicone gel prevents voltage from creeping along an insulated surface of the operating rod and/or flashing over or arcing to conductive components of the high voltage electrical connector.

As used in this disclosure, the term "high voltage" refers to equipment configured to operate at a nominal system voltage above 3 kilovolts (kV). Thus, the term "high voltage" refers to equipment suitable for use in electric utility service, such as in systems operating at nominal voltages of about 3 kV to about 38 kV, commonly referred to as "distribution" systems, as well as equipment for use in "transmission" systems, operating at nominal voltages above about 38 kV. Applicable equipment may include a circuit breaker, a grounding device, switchgear, or other high voltage equipment.

Figure 1:
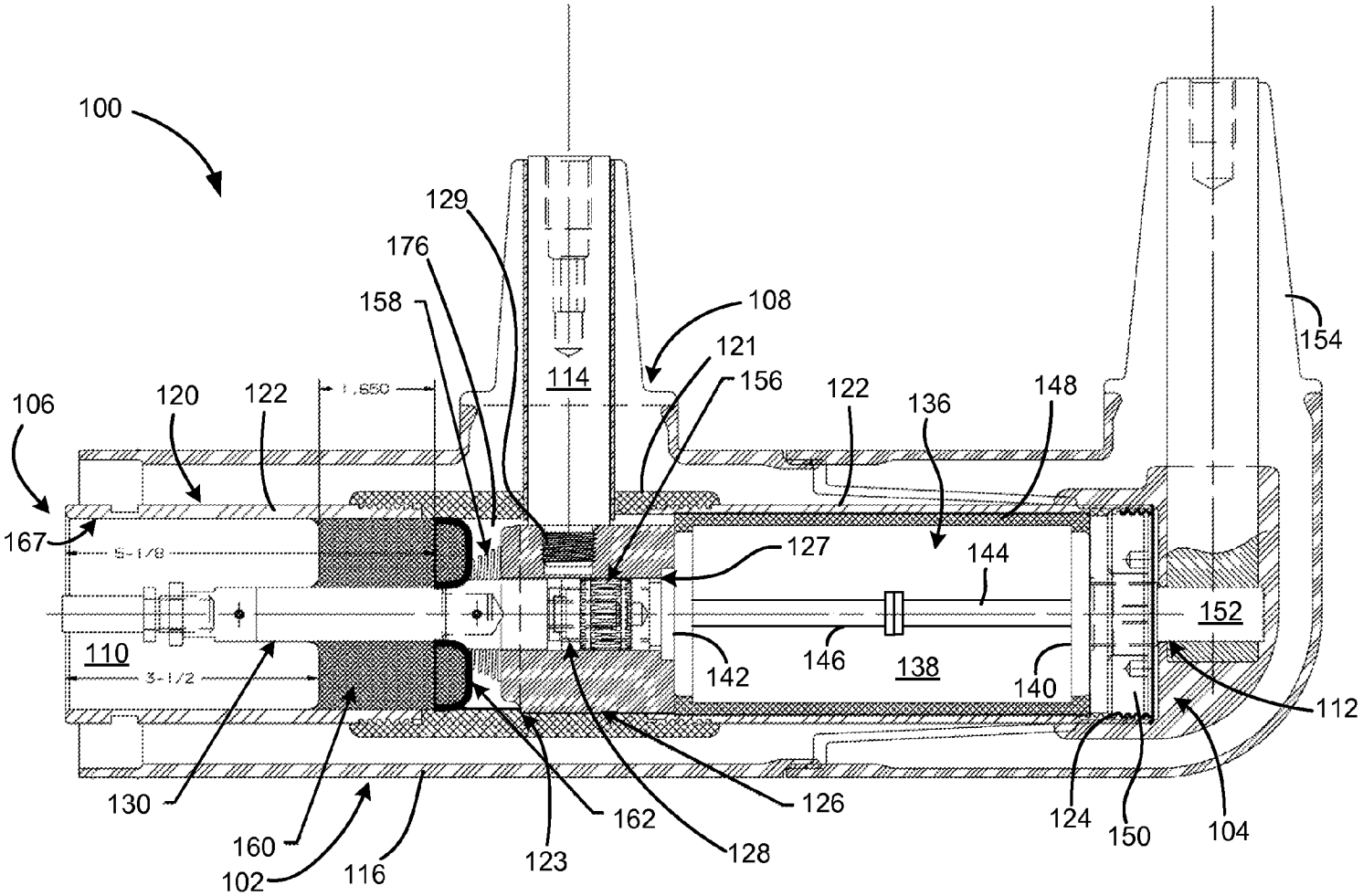
FIG. 1 is a schematic cross-sectional diagram illustrating a connector assembly in a closed position according to implementations described herein.
Figure 2:
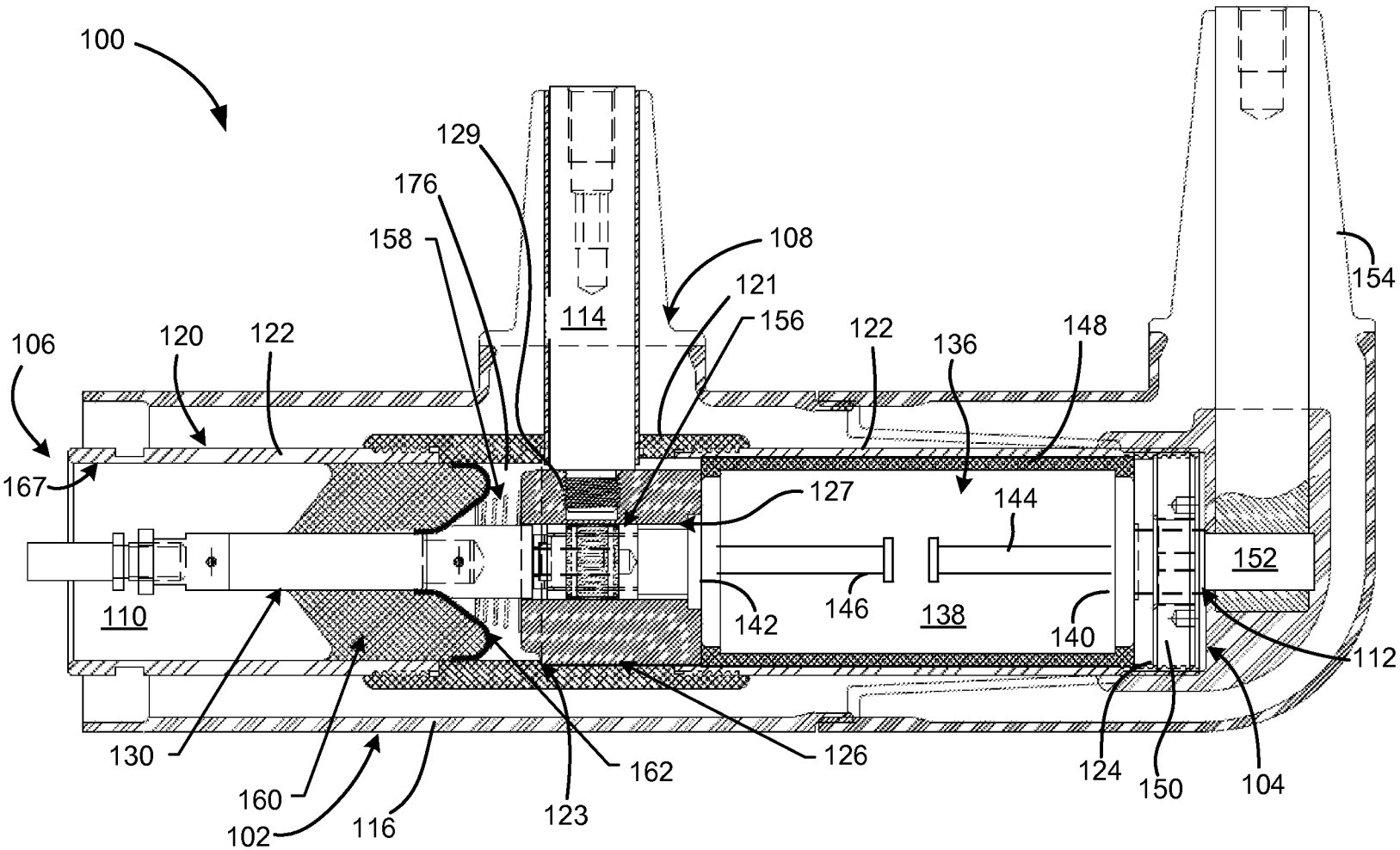
FIG. 2 is schematic cross-sectional diagram illustrating the connector assembly of FIG. 1 in an open position.

FIG. 1 is a schematic cross-sectional diagram illustrating a switch assembly 100 in an engaged ("on") position according to implementations described herein. FIG. 2 is a schematic cross-sectional diagram illustrating switch assembly 10 in a disengaged ("off") position. Referring collectively to FIGS. 1 and 2, voltage switch 100 may include a housing 102, a conductor receiving end 104, an operating end 106, and a bushing interface 108 extending substantially perpendicularly from the housing 102. Switch 100 may be configured to provide a selectable connection between conductor receiving end 104 and bushing interface 108.

Housing 102 may define an elongated bore 110 extending axially through housing 102. Conductor receiving end 104 may terminate one end of bore 110 and operating end 106 may terminate an opposite end of bore 110. Bushing interface 108 may project substantially perpendicularly from a portion of housing 102 intermediate conductor receiving end 104 and operating end 106. As described in additional detail below, switch 100 may be configured to provide mechanically moveable contact between a contact assembly 112 associated with conductor receiving end 104 and contact assembly 114 associated with bushing interface 108.

Switch assembly 100 may include an outer shield 116 formed from, for example, a dielectric silicone, elastomer or rubber, which is vulcanized under heat and pressure, such as ethylene-propylene-dienemonomer (EPDM) elastomer. In some implementations, outer shield 116 may include a number of radially extending fins (not shown) for increasing a creep distance on an exterior of housing 102. These fins are desirable in above-ground or weather-exposed switch installations, such as overhead switches or reclosers.

Within shield 116, switch 100 may include a rigid reinforcing sleeve 120 that extends substantially the entire length of housing 102 and bore 110. Reinforcing sleeve 120 may be formed from a single piece or from multiple sections (as shown in FIGS. 1 and 2). For example, in implementations described herein, reinforcing sleeve 120 may include an intermediate segment 121 onto which tubular extensions 122 are threaded or otherwise attached. Intermediate segment 121 may be made from the same or different material than tubular extensions 122. In one implementation, intermediate segment 121 may be formed from a conductive or semi-conductive material, such as aluminum. Conversely, dielectric materials can be used for tubular extensions 122. Among materials that can be used for tubular extensions 122 (or the entire reinforcing sleeve 120, if a single piece) are fiberglass reinforced epoxy, polyamides, polyvinyl chloride, and ultra high molecular weight polyethylene.

Reinforcing sleeve 120 may be provided with an annular shoulder 123 facing towards conductor receiving end 104. Reinforcing sleeve 120 protrudes slightly beyond the tip of outer shield 116 at conductor receiving end 104 and includes inner threads 124 thereon. As shown, reinforcing sleeve 120 includes an opening aligned with the bore of a bushing interface 108.

Switch 100 further includes an operating end buttress 126 positioned within reinforcing sleeve 120 in a region proximate to bushing interface 108. Operating end buttress 126 is formed from a metallic, electrically conductive material, preferably copper or a copper alloy. In one implementation, operating end buttress 126 has a cylindrical shape for engaging annular shoulder 123 in reinforcing sleeve 120. A bore 127 extends through operating end buttress 126 and is substantially coaxial with the axis of the housing 102 and reinforcing sleeve 120. As described in additional detail below, bore 127 is configured to receive a link 128 connected to an operating rod 130 that extends through operating end 106. Operating end buttress 126 may further include a threaded fitting (not labeled) for receiving a correspondingly threaded bolt 129 associated with contact assembly 114. As further discussed below, operating end buttress 126 operates as a terminal (or bus) for passage of current through switch 100 when the switch is engaged (as shown in FIG. 1). Bolt 129 maintains electrical continuity between the contact assembly 114 and operating end buttress 126.

Figure 4:
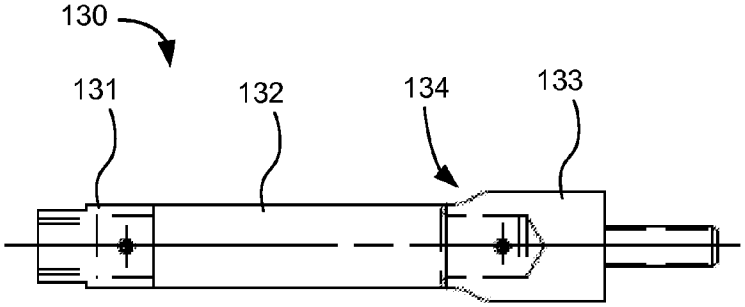
FIG. 4 is an enlarged schematic view of the driver rod of the connector assembly of FIG. 1.

FIG. 4 provides an enlarged view of operating rod 130. Operating rod 130 may include a rear connecting end 131 and a forward connecting end 133 separated by a shaft 132. Shaft 132 may be formed of an insulating material, such as fiberglass, epoxy-reinforced fiberglass, etc. In one implementation, rear connecting end 131 and forward connecting end 133 may for formed of a different material than that of shaft 132, such as steel. In other embodiments, operating rod 130 may be formed of a single component or multiple segments, such as a forward rod and a rearward rod. As shown in FIG. 4, forward connecting end 133 includes a shoulder 134 to transition to a larger diameter than that of shaft 132. As described further herein, shoulder 134 is configured to provide a stopping point for insertion of a flexible partition 162 (also referred to herein as "gel stop 162").

As shown in FIGS. 1 and 2, a contact assembly 136 is disposed between operating end buttress 126 and the conductor receiving end 104 of switch 100. In some implementations, contact assembly 136 may include a vacuum bottle assembly that includes a tubular ceramic bottle 138 having a fixed end closure 140 adjacent conductor receiving end 104 and an operating end closure 142 disposed at the opposite, operating end of the bottle 138.

A fixed contact 144 may project rearwardly into bottle 138 at fixed end closure 140 and may conductively communicate with contact assembly 112, extending forwardly from bottle 138. In some implementations, contact assembly 112 may be formed integrally with fixed contact 144. Further, although not shown in FIG. 1 or 2, operating end closure 142 may include a flexible, extensible metallic bellows coupled or otherwise attached to a moveable contact 146. Moveable contact 146 may extend out of bottle 138 and into operating end buttress 126. Vacuum bottle 138 is hermetically sealed, such that bottle 138 and contacts 144/146 are maintained gas-tight throughout the use of switch 100.

In addition, the interior space within bottle 138, surrounding contacts 144/146, has a controlled atmosphere therein. As used herein, the term "controlled atmosphere" means an atmosphere other than air at normal atmospheric pressure. For example, the atmosphere within bottle 138 may be maintained at a subatmospheric pressure. The composition of the atmosphere may also differ from normal air. For example, bottle 138 may include arc-suppressing gases such as $SF_6$ (sulphur hexafluoride).

As shown in FIGS. 1 and 2, an exterior diameter of vacuum bottle 138 may be sized slightly less than an interior diameter of reinforcing sleeve 120, so that there is an annular space between the outside of the bottle and the inside of the reinforcing sleeve 120. Upon installation of bottle 138 within reinforcing sleeve 120 (e.g., abutting a rearward end of bottle 138 against a forward shoulder of operating end buttress 126), the annular space is completely filled with a dielectric filler material 148, so as to provide a substantially void-free interface between the outside of bottle 138 and the inside of the reinforcing sleeve 120.

In one implementation, filler 148 may be formed of a dielectric material different from the dielectric material of housing 102. For example, dielectric filler 148 may be formed from a material that can be placed and brought to its final form without application of extreme temperatures or pressures. Exemplary dielectric fillers may include greases, (e.g., petroleum-based and silicone-based greases), gels (e.g., silicone gels), and curable elastomers of the type commonly referred to as room-temperature vulcanizing or "RTV" elastomers.

A fixed end buttress 150 may be provided at conductor receiving end 104 adjacent a fixed end closure 140 of bottle 138. For example, fixed end buttress 150 may engage threads 124 of reinforcing sleeve 120 and further engage fixed end closure 140. As shown, fixed end buttress 150 may include a central bore for receiving a stub contact 152 in contact with fixed end closure 140. During assembly, fixed end buttress 150 operates to force bottle 138 towards operating end buttress 126. Thus, bottle 138 is maintained under compression. As shown in FIGS. 1 and 2, stub contact 152 may be configured to receive a terminal thereon. The terminal may be configured to further couple to a contact assembly of a bushing 154 or another device installed on conductor receiving end 104.

Returning to operating end buttress 126, link 128 may be conductively coupled to moveable contact 146 and may be slidably positioned within bore 127. Link 128 may be further coupled to operating rod 130 extending through operating end 106, such that movement of operating rod 130 in an axial direction within housing 102 may cause a corresponding axial movement of moveable contact 146, into and out of contact with fixed contact 144.

In one implementation, link 128 may be coupled to the end of moveable contact 146 via a bolt, threaded connection, or another suitable attachment mechanism. Link 128 may include an annular contact 156 configured to engage an inside surface of bore 127, thereby establishing a slidable electrical connection between operating end buttress 126 and link 128. In one implementation, as shown in FIGS. 1 and 2, annular contact 156 may be configured as a set of louver contacts. In another implementation, annular contact 156 may be included on the inside surface of bore 127 to engage link 128. Additionally, link 128 may include a recess or cavity for receiving forward connecting end 133 of operating rod 130. Forward connecting end 133 may be secured to link 128 via any suitable mechanism, such as mating threads, a pin or pins, rivets, groove/snap ring, etc.

In some implementations, a coil compression spring 158 may be disposed around a forward portion of operating rod 130 between forward connecting end 133 and the end of link 128, so that motion of operating rod 130 in the closing direction (e.g., toward conductor receiving end 104) will be transmitted to link 128 and hence to moveable contact 146.

Operating rod 130 may be further coupled to ground and may further be affixed or secured to a suitable driving or actuating mechanism (not shown). For example, operating rod 130 may be attached to a manual actuation device (e.g., a handle or level), a solenoid-based actuating device, an automatic recloser device, etc. Actuation of such an actuating device may cause operating rod 130 to move forward or rearward within housing 102, thereby causing moveable contact 146 to move into and out of contact with fixed contact 144 (via link 128).

Consistent with implementations described herein, switch 100 further includes a firm, flexible, silicone gel 160 for providing voltage separation between operating end buttress 126/link 128, and operating end 106. At least a portion of bore 110 between gel stop 162 and operating end 106 is filled with a silicone gel 160 that is cured into a solid or semi-solid dielectric material. Particularly, in implementations described herein, flexible silicone gel 160 may serve as the dielectric insulating material to prevent flashover (e.g., from conductive intermediate segment 121, operating end buttress 126, or forward connecting end 133 of operating rod 130) to ground.

Figure 3A:
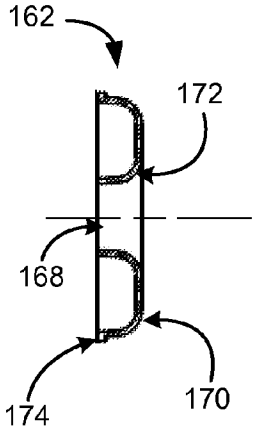
FIGS. 3A and 3B are a schematic cross-sectional view and a schematic top view of a silicone molded gel stop of the connector assembly of FIG. 1.
Figure 3B:
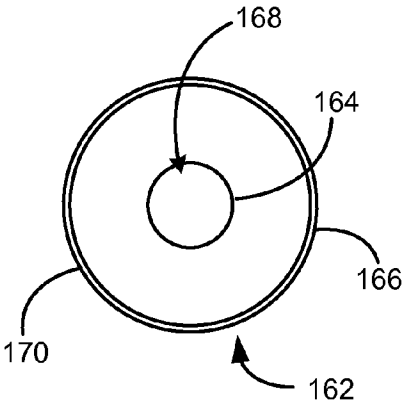

Gel stop 162 may separate gel 160 from operating end buttress 126 and/or compression spring 158. In one implementation, gel stop 162 may be molded from semi-conductive silicone-based material. In another implementation, gel stop 162 may be formed of any suitable insulative, resilient material, such as EPDM, silicone, TPE (thermoplastic elastomer), etc. FIG. 3A provides an enlarged cross-sectional view of gel stop 162, and FIG. 3B provides an enlarged top view of gel stop 162. Referring collectively to FIGS. 1-3B, gel stop 162 includes an inner edge 164 and an outer edge 166. Inner edge 164 may generally define an axial bore 168 for receiving shaft 132 of operating rod 130 therethrough. Gel stop 162 also includes an outer shoulder portion 170 and an inner shoulder portion 172. The outer shoulder portion may extend toward outer edge 166 and slightly inside of the maximum circumference to form a lip 174 around gel stop 162. Furthermore, inner shoulder portion 172 may generally extend toward inner edge 164 and form an interference fit with operating rod 130 at shoulder 134.

In one implementation, the inside diameter of inner edge 164 may be sized slightly smaller than the outside diameter of operating rod shaft 132, and the outside diameter of outer edge 166 may be sized slightly larger than the diameter of an inside surface 167 of reinforcing sleeve 120. Thus, gel stop 162 can be secured within bore 110 via an interference/friction relationship between the outside surface of operating rod 130 and the inside surface 167 of reinforcing sleeve 120. For example, gel stop 162 may be forceably inserted over operating rod 130 into bore 110 of reinforcing sleeve 120 as far as shoulder 134 of operating rod 130. Securing gel stop 162 within bore 110 via an interference fit, rather than molding or bonding gel stop 162 to reinforcing sleeve 120 and/or operating rod 130 allows gel stop 162 to be inserted following assembly of other components of switch 100 and further allows for replacement of gel 160/gel stop 162 in the event of damage or failure. Because the cured gel 160 provides a semi-permanent adhesion to operating rod 130 and inside surface 167, gel 160/gel stop 162 may be removed without damage to operating rod 130 and reinforcing sleeve 120.

When switch assembly 100 is oriented with operating end 106 facing up, silicone gel 160 may be poured into bore 110 and around operating rod 130. Silicone gel 160 may be a liquid two-part mix (e.g., including a base and a crosslinker) that is cured at room temperature or, optionally, heated to decrease cure times. In one aspect, gel 160 may be selected to provide high viscosity, tear strength, elongation, and resiliency. In an exemplary implementation, gel 160 may include SILBIONE HS firm gel LV 10-1 (from Bluestar Silicones, East Brunswick, USA).

Insertion of gel stop 162 over operating rod 130, prior to the addition of silicone gel 160, creates an air gap 176 within bore 110 between operating end buttress 126 and gel stop 162. Thus, gel stop 162 provides a retention surface to prevent gel 160 from seeping into air gap 176 during manufacture (e.g., before gel 160 is cured). Air gap 176 permits free movement of compressions spring 158 and a clean interface between operating end buttress 126 and link 128.

In cured form, silicone gel 160 may maintain shape and provide a semi-permanent adhesion to operating rod 130 and inside surface 167. In other words, the contacting surfaces of the operating rod 130 and gel 160 do not move relative to each other when operating rod 130 is moved from the engaged position (FIG. 1) to the disengaged position (FIG. 2). Similarly, the contacting surfaces of gel 160 and inside surface 167 do not move relative to each other. Instead, gel 160 may flex to accommodate the movement of operating rod 130 within bore 110. In contrast with operating rod 130 and inside surface 167, gel 160 may form a permanent bond with gel stop 162.

In one embodiment, force applied to move operating rod 130 from the engaged position to the disengaged is sufficient to overcome resistance provided by gel 160 to move operating rod the required distance in the axial direction. In one implementation, as shown in FIG. 1, silicone gel 160 may be poured around operating rod 130 to fill about 30% of the available volume between gel stop 162 and the rim of operating end 106. For example, in the particular application of FIG. 1, gel 160 may fill about 1.650 inches of a total available depth of 5.125 inches.

As a semi-conductive component, gel stop 162 may form a Faraday cage, or electrostatic shield, with intermediate segment 121 and operating end buttress 126 to minimize corona discharge that may occur when the air in air gap 176 ionizes. Corona discharge may occur, for example, when the strength of the electric field through switch 100 is enough to cause ionization, but insufficient to cause actual arcing.

As shown in FIGS. 1 and 2, gel 160 and gel stop 162 may be deformed to permit movement of operating rod 130 a predetermined distance between an engaged position (FIG. 1) and a disengaged position (FIG. 2). In one implementation, the axial travel distance of operating rod 130 may be about one-half inch. Gel 160 may be cured with operating rod 130 in an engaged position, as shown in FIG. 1. Upon rearward movement of operating rod 130, as shown in FIG. 2, operating rod 130 may travel toward operating end 106, and gel 160/shoulder portion 170 may be deflected, such that gel 160/shoulder portion 172 is pulled rearwardly along with operating rod 130.

Figure 5:
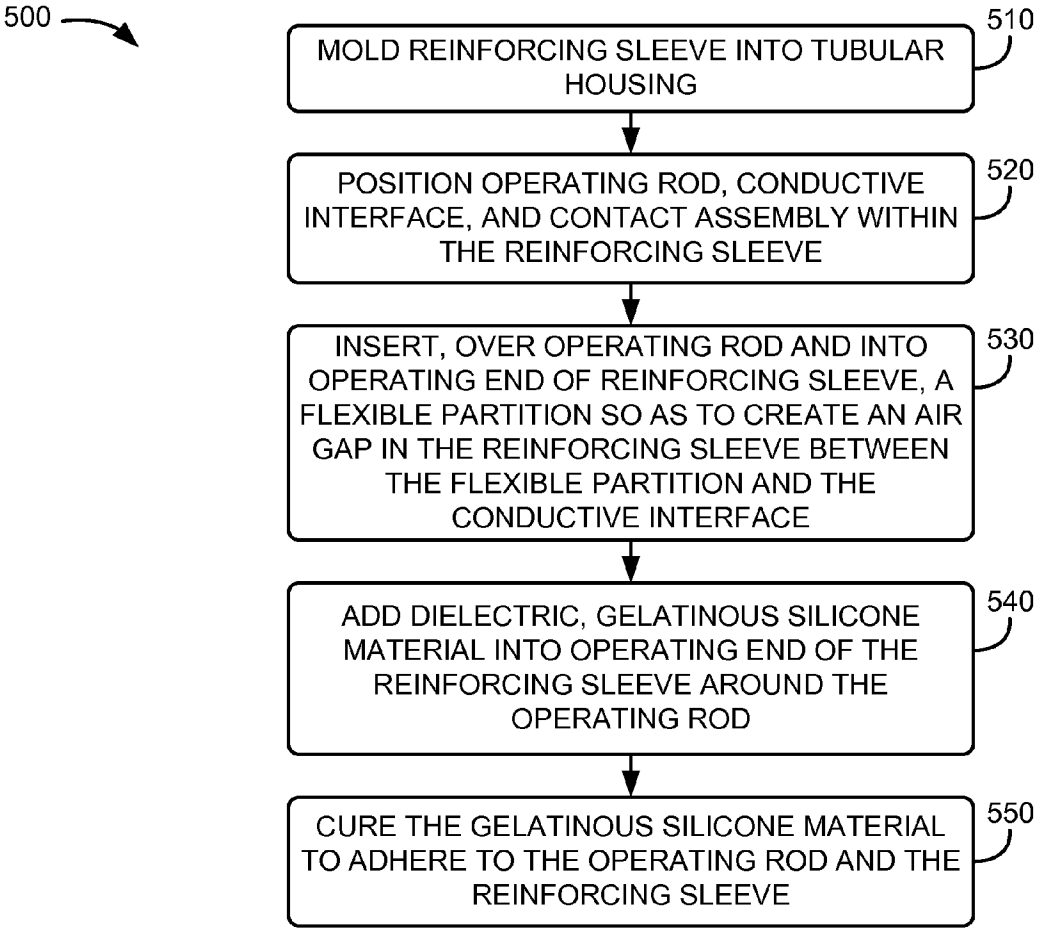
FIG. 5 is a flow diagram of a process for assembling a high-voltage switch according to an implementation described herein.

FIG. 5 is a flow diagram of a process 500 for assembling a high-voltage switch according to an implementation described herein. Process 500 may include molding a reinforcing sleeve to a tubular housing (block 510). For example, switch 100 may be assembled by molding reinforcing sleeve 120 into housing 102. The reinforcing sleeve may be pre-assembled from a conductive intermediate segment (e.g., intermediate segment 121), a first dielectric tubular extension (e.g., one of tubular extensions 122) on an operating end of the tubular housing, and a second dielectric tubular extension (e.g., one of tubular extensions 122) on a conductor receiving end of the tubular housing.

Process 500 may also include positioning an operating rod, a conductive interface, and a contact assembly within the reinforcing sleeve (block 520). For example, operating rod 130, operating end buttress 126, and a contact assembly 136 may be positioned within reinforcing sleeve 120. Operating rod 130 may be positioned to extend through the operating end toward the conductor receiving end. The operating rod may be moveable between a first position to engage contacts within the contact assembly and a second position to disengage the contacts within the contact assembly.

Process 500 may further include inserting, over the operating rod and into the reinforcing sleeve, a flexible partition (block 530). For example, gel stop 162 may be inserted over operating rod 130 into bore 110 of the reinforcing sleeve 120. Gel stop 162 may be retained against operating rod 130 and the interior surface (e.g., interior surface 167) of reinforcing sleeve 120 by a friction/interference fit. Insertion of gel stop 162 over operating rod 130, prior to the addition of silicone gel 160, may create an air gap 176 within bore 110 between operating end buttress 126 and gel stop 162.

Process 500 may also include adding a dielectric, gelatinous silicone material into the operating end of the reinforcing sleeve around the operating rod (block 540) and curing the dielectric, gelatinous silicone material to adhere to the operating rod and the reinforcing sleeve (block 550). For example, silicone gel 160 may be poured into the operating end 106 of reinforcing sleeve 120 around operating rod 130. Silicone gel 160 may be poured as a liquid two-part mix that is cured within bore 110. Gel stop 162 may prevent silicone gel 160 from reaching operating end buttress 126 prior to curing. When cured, the gelatinous silicone material may adhere to reinforcing sleeve 120 around the operating rod 130, and may permanently bond to the flexible partition. Furthermore, when cured, the gelatinous silicone material is configured to deform to maintain contact with the operating rod in the first position and the second position to prevent voltage from the conductive interface from arcing to the operating end. Because the gelatinous silicone material does not permanently bond to the reinforcing sleeve and the operating rod, the gelatinous silicone material and flexible partition may be removed/replaced during, for example, a refurbishing process.

In implementations described herein an electrical switch for high voltage applications is provided. The switch includes a tubular housing having a conductor receiving end and an operating end opposite the conductor receiving end. The tubular housing also may include a conductive interface positioned intermediate the conductor receiving end and the operating end. An operating rod may extend through the operating end toward the conductor receiving end. The operating rod may be moveable between a first position to engage the electrical switch and a second position to disengage the electrical switch. A gelatinous silicone material is provided within a portion of the tubular housing, and around the operating rod, in the operating end to prevent voltage from the conductive interface from arcing to the operating end. The gelatinous silicone material may be configured to deform to maintain contact with the operating rod in both the first position and the second position.

The foregoing description of exemplary implementations provides illustration and description, but is not intended to be exhaustive or to limit the embodiments described herein to the precise form disclosed. Modifications and variations are possible in light of the above teachings or may be acquired from practice of the embodiments. For example, implementations described herein may also be used in conjunction with other devices, such as medium or low voltage equipment.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above-mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. An electrical switch, comprising:

a tubular housing having a conductor receiving end and an operating end opposite the conductor receiving end, wherein the tubular housing includes a conductive buttress positioned intermediate the conductor receiving end and the operating end;

an operating rod extending through the operating end toward the conductor receiving end, wherein the operating rod is moveable between a first position to engage the electrical switch and a second position to disengage the electrical switch;

a gelatinous silicone material contained within a portion of the tubular housing, and around the operating rod, in the operating end to prevent voltage from the conductive buttress from arcing to the operating end, wherein the gelatinous silicone material is configured to deform to maintain contact with the operating rod in the first position and the second position; and a flexible partition located between the gelatinous silicone material and the conductive buttress, wherein the flexible partition includes a bore therethrough for receiving the operating rod, and wherein the flexible partition separates the gelatinous silicone material from the conductive buttress.

2. The electrical switch of claim 1, wherein the tubular housing includes an air gap in the operating end between the flexible partition and the conductive buttress.

3. The electrical switch of claim 2, wherein a compression spring is included within the air gap between the flexible partition and the conductive buttress.

4. The electrical switch of claim 1, wherein the flexible partition comprises a semi-conductive material.

5. The electrical switch of claim 4, wherein the semi-conductive material includes silicone.

6. The electrical switch of claim 1, wherein the tubular housing includes a reinforcing sleeve comprising an intermediate segment, a first tubular extension on a first end of the intermediate segment, and a second tubular extension on a second end of the intermediate segment.

7. The electrical switch of claim 6, wherein the intermediate segment includes one of a conductive or semi-conductive material, and wherein the first and second tubular extensions include a dielectric material.

8. The electrical switch of claim 7, wherein the flexible partition, the intermediate segment, and the conductive buttress form a faraday cage to prevent corona discharge.

9. The electrical switch of claim 1, wherein the flexible partition is secured to the operating rod via an interference fit.

10. The electrical switch of claim 1, wherein the gelatinous silicone material bonds to the flexible partition, and wherein the gelatinous silicone material adheres to the operating rod and the tubular housing in a semi-permanent manner.

11. The electrical switch of claim 1, wherein the flexible partition is configured to be inserted over the operating rod prior to providing the gelatinous silicone material into the operating end.

12. The electrical switch of claim 11, wherein the operating rod includes a shoulder portion joining a first diameter of the operating rod and a second diameter of the operating rod, such that the shoulder portion provides a stop for the insertion of the flexible partition.

13. The electrical switch of claim 1, wherein the flexible partition includes an outer circumference that is frictionally engaged with an inside of the tubular housing and an inner circumference that is frictionally engaged with the operating rod.

14. The electrical switch of claim 1, wherein the conductor receiving end further comprises:

a fixed contact electrically coupled to the conductor receiving end; and a moveable contact electrically coupled to the conductive buttress and the operating rod, wherein the moveable contact engages the fixed contact when the operating rod is in the first position, and wherein the moveable contact is disengaged from the fixed contact when the operating rod is in the second position.

15. A high-voltage electrical switch, comprising;

a tubular housing including a reinforcing sleeve, wherein the reinforcing sleeve includes a conductive intermediate segment, a first dielectric tubular extension on an operating end of the tubular housing, and a second dielectric tubular extension on a conductor receiving end of the tubular housing;

a conductive buttress positioned within the intermediate segment;

an operating rod extending through the operating end toward the conductor receiving end, wherein the operating rod is moveable between a first position to engage the electrical switch and a second position to disengage the electrical switch;

a gelatinous dielectric material contained within a portion of the reinforcing sleeve to prevent voltage from the conductive buttress from arcing to the operating end, wherein the gelatinous dielectric material is configured to deform to maintain contact with the operating rod in the first position and the second position; and a flexible partition located between the gelatinous dielectric material and the conductive buttress, wherein the flexible partition includes a bore therethrough for receiving the operating rod, and wherein the flexible partition separates the gelatinous dielectric material from the conductive buttress.

16. The high-voltage switch of claim 15, wherein the operating rod includes a shaft of a dielectric material.

17. The high-voltage switch of claim 15, further comprising:

an air gap within a portion of the reinforcing sleeve between the flexible partition and the conductive buttress.

18. The high-voltage switch of claim 15, wherein the gelatinous dielectric material adheres to the operating rod and the tubular housing in a semi-permanent manner.

19. A method of assembling a high-voltage switch, the method comprising:

molding a reinforcing sleeve into a tubular housing, wherein the reinforcing sleeve includes a conductive intermediate segment, a first dielectric tubular extension on an operating end of the tubular housing, and a second dielectric tubular extension on a conductor receiving end of the tubular housing;

positioning an operating rod, a conductive buttress, and a contact assembly within the reinforcing sleeve, wherein the operating rod is positioned to extend through the operating end toward the conductor receiving end, and wherein the operating rod is moveable between a first position to engage contacts within the contact assembly and a second position to disengage the contacts within the contact assembly;

inserting, over the operating rod and into the reinforcing sleeve, a flexible partition, wherein the flexible partition is retained against the operating rod and an interior surface of the reinforcing sleeve by an interference fit; and adding components of a dielectric, gelatinous silicone material into the operating end of the reinforcing sleeve around the operating rod, wherein the gelatinous silicone material cures and adheres to the operating rod such that contacting surfaces of the operating rod and the gelatinous silicone material do not move relative to each other when operating rod is moved from the first position to the second position, and wherein the flexible partition prevents the gelatinous silicone material from reaching the conductive buttress prior to the curing.

20. The method of claim 19, wherein the gelatinous silicone material bonds to the flexible partition.

* * * * *